US010294709B2

(12) United States Patent
Pålsson et al.

(10) Patent No.: US 10,294,709 B2
(45) **Date of Patent: *May 21, 2019**

(54) REVOLVING DOOR ASSEMBLY COMPRISING SUPPORT ROD

(71) Applicant: ASSA ABLOY Entrance Systems AB, Landskrona (SE)

(72) Inventors: Ingemar Pålsson, Lund (SE); Sven Åsbo, Ramlösa (SE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 301 days.

This patent is subject to a terminal disclaimer.

(21) Appl. No.: 15/302,150

(22) PCT Filed: Mar. 25, 2015

(86) PCT No.: PCT/EP2015/056464

§ 371 (c)(1),
(2) Date: Oct. 5, 2016

(87) PCT Pub. No.: WO2015/155013

PCT Pub. Date: Oct. 15, 2015

(65) Prior Publication Data

US 2017/0183902 A1 Jun. 29, 2017

(30) Foreign Application Priority Data

Apr. 10, 2014 (SE) ..... 1450448

(51) Int. Cl.
*E05D 15/02* (2006.01)
*E05F 15/608* (2015.01)

(52) U.S. Cl.
CPC ..... *E05F 15/608* (2015.01); *E05D 15/02* (2013.01); *E05Y 2201/72* (2013.01);
(Continued)

(58) Field of Classification Search
CPC ..... E05F 15/608; E05F 15/614; E05F 15/44; E05F 15/73; E05F 15/70; E05D 15/02;
(Continued)

(56) References Cited

U.S. PATENT DOCUMENTS 3,307,660 A 3/1967 Sheckells
3,766,686 A 10/1973 Sheckells
(Continued)

FOREIGN PATENT DOCUMENTS

CN 2538929 3/2003
CN 2764903 3/2006
(Continued)

OTHER PUBLICATIONS

First Office Action mailed in CN Application 201580017336.1 dated Sep. 13, 2017 (8 pages).
(Continued)

*Primary Examiner* — Chi Q Nguyen
(74) *Attorney, Agent, or Firm* — Wissing Miller LLP

(57) ABSTRACT

A revolving door assembly is disclosed. The door comprises a central column and at least one door panel connected to the central column and rotatably arranged around a central axis (X). The central column comprises a drive unit. The drive unit comprises a motor and an oscillating gear. The oscillating gear comprises at least one rod through hole. A non-rotating support rod passes through the rod through hole and supports the motor. Also disclosed is a driving base unit for a revolving door assembly.

14 Claims, 5 Drawing Sheets

(52) U.S. Cl.
CPC ..... *E05Y 2400/654* (2013.01); *E05Y 2600/41* (2013.01); *E05Y 2800/262* (2013.01); *E05Y 2800/72* (2013.01); *E05Y 2900/132* (2013.01)

(58) Field of Classification Search
CPC ..... E05Y 2201/72; E05Y 2400/72; E05Y 2400/654; E05Y 2600/61; E05Y 2800/262; E05Y 2900/132; E06B 3/90
USPC ..... 49/42, 44; 109/8
See application file for complete search history.

(56) References Cited

U.S. PATENT DOCUMENTS

| | | | | |
|---|---|---|---|---|
| 4,341,165 | A * | 7/1982 | Calandritti | E05G 5/003 109/8 |
| 4,581,849 | A * | 4/1986 | Schwarz | E05D 15/02 49/29 |
| 4,785,580 | A | 11/1988 | Olesen | |
| 4,800,679 | A * | 1/1989 | Appelmann | E05D 15/02 49/42 |
| 4,970,825 | A * | 11/1990 | Knarvik | E05D 15/02 49/44 |
| 5,012,455 | A * | 4/1991 | Schwarz | E05G 5/003 109/8 |
| 5,773,943 | A | 6/1998 | Andersen | |
| 6,266,922 | B1 * | 7/2001 | Rockenbach | E05D 15/02 49/42 |
| 6,418,810 | B1 | 7/2002 | Kerr | |
| 6,742,301 | B1 * | 6/2004 | Schwarz | E05G 5/003 49/42 |
| 7,104,008 | B2 * | 9/2006 | Yokotachi | E06B 3/90 49/40 |
| 8,191,312 | B2 * | 6/2012 | Wang | E05D 15/48 49/42 |
| 8,475,315 | B2 | 7/2013 | Kobayashi et al. | |
| 2005/0045078 | A1 * | 3/2005 | Chen | E05G 5/02 109/8 |
| 2008/0016772 | A1 * | 1/2008 | Rockenbach | E06B 3/90 49/42 |
| 2008/0028682 | A1 * | 2/2008 | Casella | E05G 5/003 49/25 |
| 2016/0123064 | A1 * | 5/2016 | Wagner | E05F 15/632 49/349 |

FOREIGN PATENT DOCUMENTS

| | | |
|---|---|---|
| DE | 4422454 | 1/1996 |
| DE | 19711460 | 11/1997 |
| DE | 299 10 847 U1 | 11/1999 |
| DE | 10 2005 030755 A1 | 1/2007 |
| DE | 4221083 | 1/2007 |
| DE | 20 2008 005104 U1 | 6/2008 |
| WO | 92008868 | 5/1992 |

OTHER PUBLICATIONS

International Search Report and Written Opinion dated Jun. 5, 2015 in corresponding International Aprlication No. PCT/EP2015/056464.

International-Type Search Report dated Nov. 18, 2014 in corresponding Sweden Priority Application No. 1450448-4.

* cited by examiner

REVOLVING DOOR ASSEMBLY COMPRISING SUPPORT ROD

CROSS-REFERENCE TO RELATED APPLICATIONS

This application is the National Stage entry under 35 U.S.C. § 371 of International Application No. PCT/EP2015/056464 filed on Mar. 25, 2015, published on Oct. 15, 2015 under Publication Number WO 2015/155013, which claims the benefit of priority under 35 U.S.C. § 119 of Sweden Patent Application Number 1450448-4 filed Apr. 10, 2014.

TECHNICAL FIELD

The present invention relates to a revolving door assembly comprising a central column and at least one door panel connected to the central column and rotatably arranged around a central axis.

BACKGROUND ART

Revolving doors are manufactured in different sizes. The size of a revolving door may be dependent on the number of people that are expected to walk through the revolving door and the desired size to visually fit the building and/or to achieve a particular image. The size of a revolving door may also be dependent on the size of an existing revolving door to be replaced or the opening in a building or inner wall in which the revolving door is installed. In order to meet the required size each revolving door is manufactured based on the desired size in a customized fashion.

Revolving doors are in many installations automatically controlled and therefore have a drive unit including a motor and usually a gear. The drive unit may be installed above the door panels of the revolving door such as in DE 196 06 200 A1, EP 340 771 A1 and some embodiments of DE 94 21 367 U1. However, the location of the drive unit above the door panels results in an increased height of the revolving door and cover sheets or panels above the door panels are required to conceal the drive unit as seen in FIG. 1 of DE 94 21 367 U1. Cover sheets or cover panels may disturb the aesthetic appearance, in particular when the revolving door is installed in a building having a glass facade.

The drive unit may also be located in a pit in the floor as in DE 94 21 367 U1 (see e.g. FIG. 3). However, this requires extensive modification and rebuilding of the floor and may not be possible e.g. if there is a story, such as a basement, below the installation site of the revolving door.

The drive unit may also be located in a central body of the revolving door as in WO 92/08868 A1, DE 94 21 367 U1 (see e.g. FIG. 1) and DE 197 11 460 A1. However, the location in a central body results in a bulky construction that requires a large central body and thus a large revolving door with a large installation width is required or if the total width of the revolving door is limited the passage capacity is decreased. The large and bulky central body may also disturb the aesthetic appearance of the revolving door.

In DE 10 2005 030 755 A1 a drive unit is partially located in a centre pillar of the revolving door and mounted to the ceiling construction above the door panels. A bearing guiding the centre pillar is also mounted to the ceiling construction. The location of the drive unit partially above the door panels results in an increased height of the revolving door and disturbs the aesthetic appearance of the revolving door.

All the above described revolving doors according to prior art also requires extensive installation as well as comprehensive customization of the revolving door.

Thus, there exists a need for an improved revolving door.

SUMMARY OF THE INVENTION

One object of the present invention is to facilitate installation of a revolving door. One object of the present invention is to reduce the time for installation of a revolving door. One object of the present invention is to achieve fast replacement of a revolving door. One object of the present invention is to achieve an aesthetically appealing appearance of a revolving door. One object of the present invention is to achieve a revolving door having a compact design.

These and further objects are achieved by a revolving door assembly comprising a central column and at least one door panel connected to the central column and rotatably arranged around a central axis. The central column comprises a drive unit comprising a motor and a gear. The gear comprises at least one rod through hole. A support rod passes through the rod through hole and support the motor.

The rod through hole enables arrangement of a support rod through the gear, which support rod supports the motor. The rod through hole reduces the size of the central column and thereby achieves a compact design, since a motor arranged above the gear can be supported below the gear through the gear, which implies that no support for the motor has to be provided between the gear and the wall of the central column. The reduced diameter of the central column also improves the aesthetic appearance of the revolving door assembly. The rod through hole and the support rod also facilitates the arrangement of a gear and a motor supported by a common support, such as a driving base unit or a support structure, which implies that the common support can be mounted as one unit including the motor and the gear during installation and thereby the installation is facilitated, the time for the installation is reduced and fast replacement of a revolving door is achieved.

In one aspect, the gear comprises a gear through channel. The through channel of the gear enables a power cable to be led through the gear. Thereby, a power cable can be supplied at either side of the gear, such as above or below the gear, and led to a motor regardless at what side of the gear the motor is located, e.g. regardless if the motor is located above or below the gear. Thus, the revolving door assembly of the present invention provides a plurality of options for power connection of a revolving door. Thereby, the revolving door assembly of the present invention provides a flexible and optional power connection of a revolving door. Since a power cable can be provided at a plurality of locations, a location where the power cable is less visible can be chosen and thus an aesthetically appealing appearance of a revolving door is obtained. Since a power cable can be led through the gear no separate space outside the gear for accommodating a power cable is needed and thereby a compact design is achieved. Since a power cable can be provided at a plurality of locations of the revolving door assembly, a location which is easily accessible by a power supply cable can be chosen, such a location where a short cable path from e.g. an electrical connector or cabinet to the location can be chosen or a location where no or minor preparation of the installation site is necessary. Thereby, the installation of a revolving door is facilitated, the time for installation of a revolving door is reduced and fast replacement of a revolving door is achieved.

In one aspect, the rod through hole of the gear connects a top side of the gear with a bottom side of the gear. Thereby, a support rod can pass through the gear from below the gear to above the gear and thereby e.g. support a motor located above the gear.

In one aspect, the gear is an oscillating gear. By having an oscillating gear an oscillating part which does not rotate is present in the gear. This facilitates arrangement of static objects through the gear, such as a support rod.

In one aspect, the oscillating gear is arranged to transform a rotating movement from the motor into an oscillating movement in the gear and back to a rotating movement of the door panel. Thereby, the rotating movement of the motor shaft rotates the door panel via an oscillating movement of an oscillating part in the gear. The oscillating part facilitates the arrangement of static objects through the gear, such as a support rod.

In one aspect, the central column comprises a driven column and a driving base unit and the driving base unit comprises the drive unit, wherein the driving base unit comprises the support rods and the motor is connected to the support rods. Since the driving base unit comprises the gear and the support rods and the motor is connected to the support rods, the gear and the motor are supported by a common support in the form of the driving base unit, which implies that the driving base unit can be mounted as one unit including the motor and the gear during installation and thereby the installation of a revolving door is facilitated, the time for the installation of a revolving door is reduced and fast replacement of a revolving door is achieved.

In one aspect, the gear comprises an oscillating part, which oscillating part comprises the rod through hole of the gear. By arranging the rod through hole in an oscillating part, the rod through hole is arranged in a part that does not rotate. This facilitates the arrangement of a hole through the gear and arrangement of static objects through the gear, such as a support rod.

In one aspect, the rod through hole is arranged displaced from the centre of the oscillating part. Arrangement of the rod through hole displaced from the centre of the oscillating part implies that the rod through hole is arranged at a distance from the centre of the oscillating part. Thus, also the support rod is arranged displaced from the centre of the oscillating part. Thereby, a stable support for the motor can be achieved, in particular when a plurality of rod through holes and support rods are present. Support of the motor at a plurality of points that are separated is enabled. The stability of the support for the motor is increased. Displaced arrangement of the rod through hole also leaves the centre unoccupied and therefore e.g. a gear through channel and a cable can be arranged in the centre.

In one aspect, the gear through channel of the gear is arranged in the centre of the oscillating part. Arrangement of the gear through channel in the centre of the oscillating part is a convenient way of achieving a suitable through channel. Arrangement of the gear through channel in the centre of the oscillating part facilitates arrangement of a through channel, such as the base through channel and (portion of) the main through channel in the centre of the revolving door assembly. Arrangement of a through channel in the centre of other parts is thereby also facilitated. For example may a support structure, and in particular a bottom support, of the driving base unit have a through channel in its center, which simplifies a rigid construction of these parts that makes the whole revolving door assembly stable.

In one aspect, the support rod is static. Thus, the support rod stands still, does not move and does not rotate. Thereby, the support for the motor is stable.

In one aspect, the motor is arranged offset in relation to the centre axis of the revolving door. Thereby, a through channel, such as the base through channel and the main through channel, which may accommodate a cable, is easily arranged parallel to the motor.

In one aspect, the motor is arranged offset in relation to an input member of the gear. Thereby, the motor can be displaced in relation to the gear such that a narrow central column can be achieved. In particular if the input member of the gear is displaced in relation to the centre of the gear, the motor can be displaced in relation to the input member towards the centre of the gear such that a narrow central column can be used. The motor can also be displaced such that space for accommodating a through channel, such as the main through channel and the base through channel, is available next to the motor.

In one aspect, the revolving door assembly is freestanding. Thereby, the revolving door assembly stands by its own and does not need any support or guiding, such as bearings, at the top of the revolving door assembly. The complete support is located at the bottom of the revolving door assembly. Thereby, the installation of a revolving door is facilitated, the time for installation of a revolving door is reduced and fast replacement of a revolving door is achieved since no fitting of the revolving door assembly to the top of the opening is necessary. Also an aesthetically appealing revolving door is obtained due to the absence of upper support and guiding means.

In one aspect, the height of the driven column is adaptable. Other parts of the revolving door assembly, such as a driving base unit including a drive unit can be pre-assembled and possibly kept at stock and only the driven column is adapted to the installation. Thereby, the delivery times of a revolving door are decreased, the installation of a revolving door is facilitated, the time for the installation of a revolving door is decreased and fast replacement of a revolving door is achieved.

The above and further objects are also achieved by a driving base unit for a revolving door assembly comprising a central column and at least one door panel connected to the central column and rotatably arranged around a central axis. The driving base unit comprises a drive unit comprising a motor and a gear. The gear comprises at least one rod through hole. A support rod passes through the rod through hole and support the motor.

The rod through hole enables arrangement of a support rod through the gear, which support rod supports the motor. The rod through hole reduces the size of the central column and thereby achieves a compact design, since a motor arranged above the gear can be supported below the gear through the gear, which implies that no support for the motor has to be provided between the gear and the wall of the central column. The reduced diameter of the central column also improves the aesthetic appearance of the revolving door assembly. The rod through hole and the support rod also facilitates the arrangement of a gear and a motor supported by a common support, such as a driving base unit or a support structure, which implies that the common support can be mounted as one unit including the motor and the gear during installation and thereby the installation is facilitated, the time for the installation is reduced and fast replacement of a revolving door is achieved.

In one aspect, the gear comprises a gear through channel. The through channel of the gear enables a power cable to be led through the gear. Thereby, a power cable can be supplied at either side of the gear, such as above or below the gear, and led to a motor regardless at what side of the gear the motor is located, e.g. regardless if the motor is located above or below the gear. Thus, the driving base unit of the present invention provides a plurality of options for power connection of a revolving door. Thereby, the driving base unit of the present invention provides a flexible and optional power connection of a revolving door. Since a power cable can be provided at a plurality of locations, a location where the power cable is less visible can be chosen and thus an aesthetically appealing appearance of a revolving door is obtained. Since a power cable can be led through the gear no separate space outside the gear for accommodating a power cable is needed and thereby a compact design is achieved. Since a power cable can be provided at a plurality of locations of the driving base unit and the revolving door assembly, a location which is easily accessible by a power supply cable can be chosen, such a location where a short cable path from e.g. an electrical connector or cabinet to the location can be chosen or a location where no or minor preparation of the installation site is necessary. Thereby, the installation of a revolving door is facilitated, the time for installation of a revolving door is reduced and fast replacement of a revolving door is achieved.

In one aspect of a driving base unit according to above, the rod through hole of the gear connects a top side of the gear with a bottom side of the gear. Thereby, a support rod can pass through the gear from below the gear to above the gear and thereby e.g. support a motor located above the gear.

In one aspect of a driving base unit according to above, the gear is an oscillating gear. By having an oscillating gear an oscillating part which does not rotate is present in the gear. This facilitates arrangement of static objects through the gear, such as a support rod.

In one aspect of a driving base unit according to above, the oscillating gear is arranged to transform a rotating movement from the motor into an oscillating movement in the gear and back to a rotating movement of the door panel. Thereby, the rotating movement of the motor shaft rotates the door panel via an oscillating movement of an oscillating part in the gear. The oscillating part facilitates arrangement of static objects through the gear, such as a support rod.

In one aspect of a driving base unit according to above, the driving base unit comprises the support rods and the motor is connected to the support rods. Since the driving base unit comprises the gear and the support rods and the motor is connected to the support rods, the gear and the motor are supported by a common support in the form of the driving base unit, which implies that the driving base unit can be mounted as one unit including the motor and the gear during installation and thereby the installation of a revolving door is facilitated, the time for the installation of a revolving door is reduced and fast replacement of a revolving door is achieved.

In one aspect of a driving base unit according to above, the gear comprises an oscillating part, which oscillating part comprises the rod through hole of the gear. By arranging the rod through hole in an oscillating part, the rod through hole is arranged in a part that does not rotate. This facilitates the arrangement of a hole through the gear and arrangement of static objects through the gear, such as a support rod.

In one aspect of a driving base unit according to above, the rod through hole is arranged displaced from the centre of the oscillating part. Arrangement of the rod through hole displaced from the centre of the oscillating part implies that the rod through hole is arranged at a distance from the centre of the oscillating part. Thus, also the support rod is arranged displaced from the centre of the oscillating part. Thereby, a stable support for the motor can be achieved, in particular when a plurality of rod through holes and support rods are present. Support of the motor at a plurality of points that are separated is enabled. The stability of the support for the motor is increased. Displaced arrangement of the rod through hole also leaves the centre unoccupied and therefore e.g. a gear through channel and a cable can be arranged in the centre.

In one aspect of a driving base unit according to above, the gear through channel of the gear is arranged in the centre of the oscillating part. Arrangement of the gear through channel in the centre of the oscillating part is a convenient way of achieving a suitable through channel. Arrangement of the gear through channel in the centre of the oscillating part facilitates arrangement of a through channel, such as the base through channel in the centre of the revolving door assembly. Arrangement of a through channel in the centre of other parts is thereby also facilitated. For example may a support structure, and in particular a bottom support, of the driving base unit have a through channel in its center, which simplifies a rigid construction of these parts that makes the driving base unit and the whole revolving door assembly stable.

In one aspect of a driving base unit according to above, the support rod is static. Thus, the support rod stands still, does not move and does not rotate. Thereby, the support for the motor is stable.

In one aspect of a driving base unit according to above, the motor is arranged offset in relation to the centre axis of the revolving door. Thereby, a through channel, such as the base through channel and the gear through channel, which may accommodate a cable, is easily arranged parallel to the motor.

In one aspect of a driving base unit according to above, the motor is arranged offset in relation to an input member of the gear. Thereby, the motor can be displaced in relation to the gear such that a narrow central column can be achieved. In particular if the input member of the gear is displaced in relation to the centre of the gear, the motor can be displaced in relation to the input member towards the centre of the gear such that a narrow central column can be used. The motor can also be displaced such that space for accommodating a through channel, such as the main through channel and the base through channel, is available next to the motor.

In one aspect of a driving base unit according to above, the driving base unit is freestanding. Thereby, the driving base unit stands by its own. Also the revolving door assembly may then be freestanding and stand by its own such that it does not need any support or guiding, such as bearings, at the top of the revolving door assembly. The complete support is located at the bottom of the driving base unit. Thereby, the installation of a revolving door is facilitated, the time for installation of a revolving door is reduced and fast replacement of a revolving door is achieved since the driving base unit only has to be mounted to the bottom of the opening. No fitting of the revolving door assembly to the top of the opening is necessary. Also an aesthetically appealing revolving door is obtained due to the absence of upper support and guiding means.

In one aspect of a driving base unit according to above, the central column comprises a driven column and the driving base unit and the height of the driven column is adaptable. Other parts of the revolving door assembly, such as the driving base unit including a drive unit can be pre-assembled and possibly kept at stock and only the driven column is adapted to the installation. Thereby, the delivery times of a revolving door are decreased, the installation of a revolving door is facilitated, the time for the installation of a revolving door is decreased and fast replacement of a revolving door is achieved.

Further objects and features of the present invention will appear from the following detailed description of embodiments of the invention.

BRIEF DESCRIPTION OF THE DRAWINGS

The invention will be described in more detail with reference to the accompanying drawings, in which.

DETAILED DESCRIPTION

Figure 1:
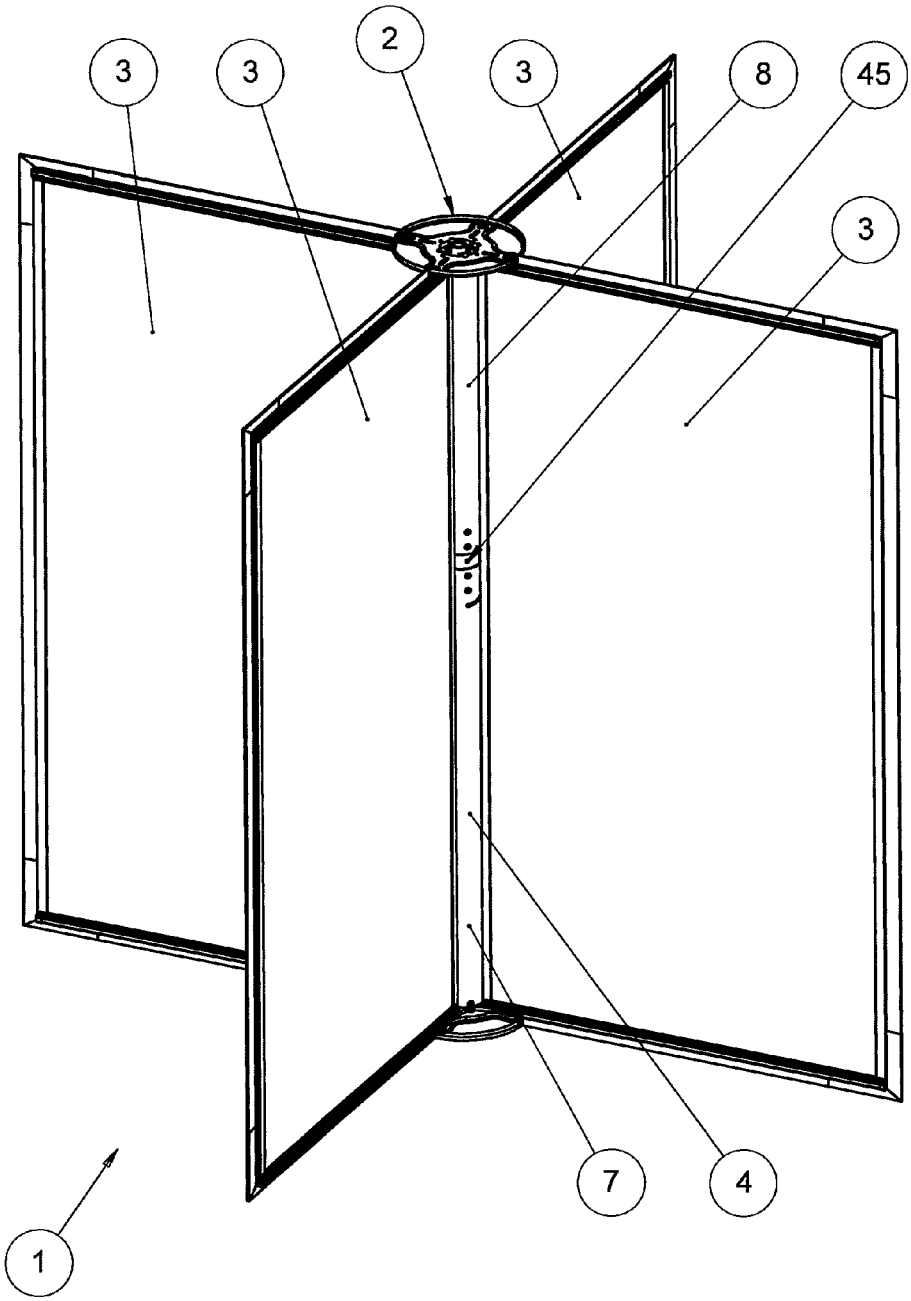
FIG. 1 is a perspective view of a revolving door assembly according to the present invention.
Figure 2:
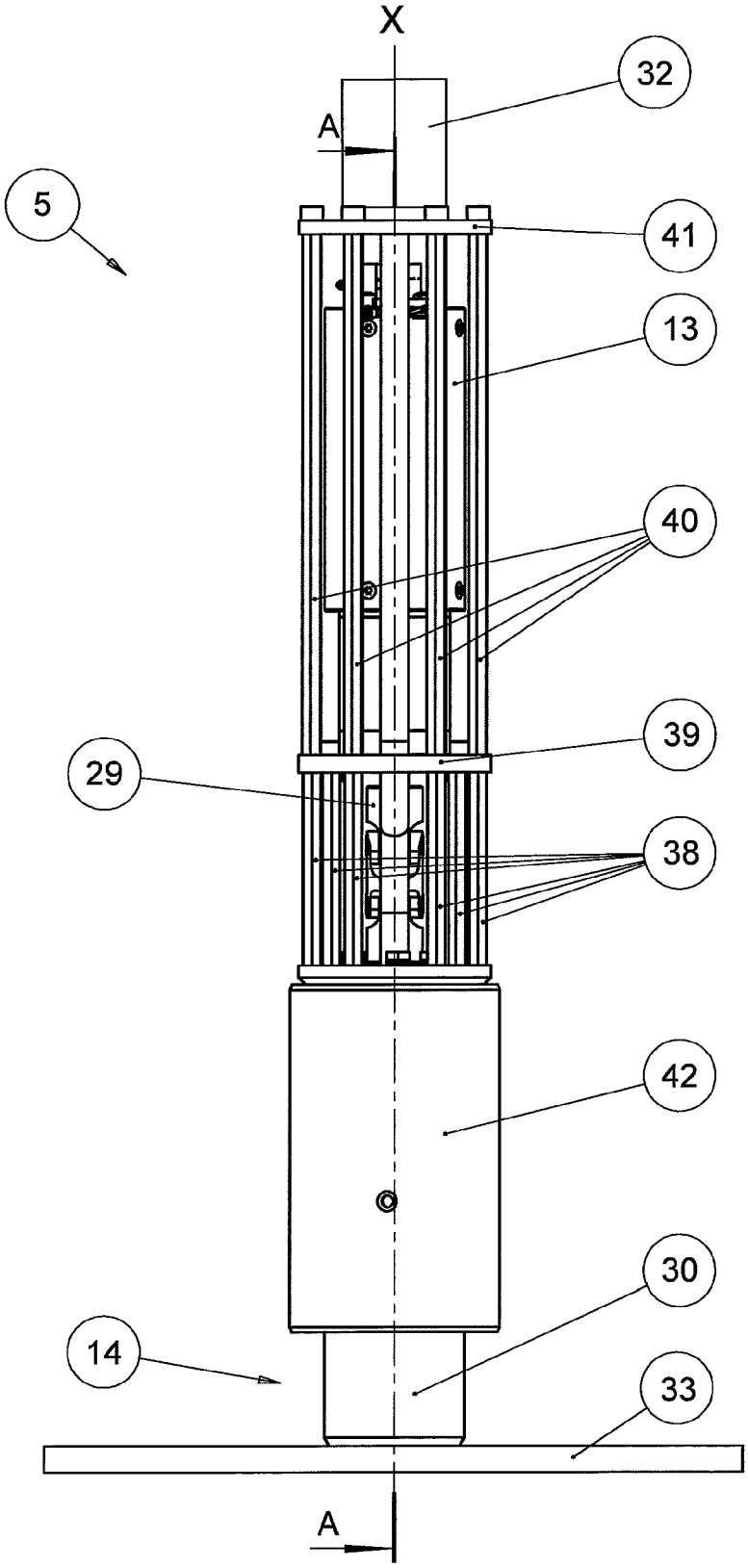
FIG. 2 is a front view of a driving base unit of a revolving door assembly according to the present invention.

A revolving door assembly 1 comprising a central column 2 and at least one door panel 3 connected to the central column 2 and rotatably arranged around a central axis X is shown in FIG. 1 and details thereof are shown in FIGS. 2-5.

The central column 2 comprises a driven column 4 and a driving base unit 5. The driving base unit 5 is arranged to drive the driven column 4 to rotate the driven column 4 and the door panels 3 connected to the driven column 4 around said central axis X. The driven column 4 is thereby driven by the driving base unit 5 and the driving base unit 5 drives the driven column 4. Thereby, the driving base unit 5 is an active part in the rotation of the driven column 4 and the driven column 4 is a passive part in the rotation of the driven column 4.

The driving base unit 5 comprises a drive unit 6. The drive unit 6 comprises a motor 13. The motor 13 is arranged to rotate the door panels 3 connected to the central column 2 around said central axis X. The motor 13 is arranged to rotate the driven column 4 and the door panels 3 connected to the driven column 4 around said central axis X. The driven column 4 is connected to the drive unit 6. The driven column 4 is driven by the drive unit 6.

The drive unit 6 is enclosed within the driven central column 2. The drive unit is enclosed in the central column and no separate drive unit adapted to the installation site, such as the building in which the revolving door assembly is to be installed and the possibility of placing e.g. a control unit at the installation site, is needed. The drive unit can be a standard drive unit and possibly kept at stock. Thus, the delivery time of a revolving door is decreased, the installation of a revolving door is facilitated and the time for the installation thereof is reduced. Since the drive unit is enclosed within the central column, the drive unit is not located outside the central column and not visible from the outside of the revolving door assembly and thus an aesthetic appearance is achieved, which in particular is advantageous when installed in an opening of a building having a glass facade. The drive unit is enclosed in the central column and thereby a compact design is achieved.

The driving base unit 5 is arranged within the driven column 4. By arranging the driving base unit comprising the drive unit within the driven column, achievement of a compact and aesthetically appealing design is facilitated, since the driving base unit is covered by the driven column.

The driven column 4 is supported by the driving base unit 5. Thus, the weight of the driven column 4 is carried by the driving base unit 5. The driven column 4 is mounted to the driving base unit 5.

The driven column 4 extends above the driving base unit 5. Thus, the top of the driven column 4 is located above the top of the driving base unit 5. The driven column extends above the top of the driving base unit. Since the driven column 4 extends above the driving base unit 5, the driving base unit 5 is not located within the upper portion of the driven column 4. Thus, the upper portion of the driven column 4 does not encompass the driving base unit 5 or the drive unit 6 of the driving base unit 5. The driven column 4 extends above driving base unit 5 from the bottom of the opening. Thereby, the driven column is easily adaptable to the installation, e.g. by cutting.

The revolving door assembly 1 has at least one door panel 3. The revolving door assembly 1 may comprise two, three, four, five, six or more door panels 3. Revolving doors having two to four door panels are the most common configurations. The revolving door assembly 1 shown in FIG. 1 has four door panels 3.

The revolving door assembly 1 may be for installation in an opening. The opening can be an opening in a building wall, such as a facade or outer wall or an interior wall. The opening can be limited by a right and a left restriction, such as a right and a left door jamb. The opening can also be limited by a bottom restriction, such as a floor or ground. The opening may also be limited by a top restriction, such as a ceiling or top door jamb. The opening may also be without top restriction, i.e. with an open top, which may be the case for example when the opening is arranged in an indoor partition dividing a room in smaller areas or when the opening is arranged in a fence. The revolving door assembly of the present invention may be arranged in an opening with an open top since it may be arranged as a freestanding revolving door.

The height of the driven column 4 from the bottom of the opening exceeds the height of the driving base unit 5 from the bottom of the opening. Since the height of the driven column 4 exceeds the height of the driving base unit 5, the driving base unit 5 is not located within the upper portion of the driven column 4. Thus, the upper portion of the driven column 4 does not encompass the driving base unit 5 or the drive unit 6 of the driving base unit 5. Thereby, the driven column is easily adaptable to the installation, e.g. by cutting.

The height of the driven column 4 is adaptable. Since the height of the driven column 4 is adaptable, the driving base unit 5 can have a standard configuration that is equal for all or at least several revolving doors. The driving base unit 5 may have a fixed standard height. Then the height of the driven column 4 is customized to fit the installation, such as the height of the opening. The height of the driven column 4 may be adaptable to the desired height of installation. The height of the driven column 4 may be adaptable to the height of the opening. The height of the driven column 4 can be easily adapted e.g. by cutting a column to a desired height (which can be seen as a length before installation). The driven column 4 can also be provided in various heights to fit different installations. The driving base unit 5 can be a standard piece that is totally premanufactured and kept at stock e.g. at the manufacturer. The driving base unit 5 may be a standard unit. The driving base unit 5 may have a standard height. The standard height may be the same for all sizes of revolving doors. By only having to adapt the height of the driven column 4, the revolving door 1 can be delivered very fast from the stock. The driven column 4 can be adapted, e.g. by cutting, at the manufacturer before shipping or at the site of installation by the person performing the installation. Preferably, all driving and controlling equipment performing the rotation of the revolving door assembly 1 is included in the driving base unit 5. The driven column 4 can simply be cut by sawing or machining. The driven column 4 may be a tube, which may be made of metal, such as aluminum, or any other suitable material.

The height of the driven column 4 may be adaptable such that the height of the central column 2 is essentially equal to or larger than the height of the door panel 3. By adapting the height of the driven column 4 such that the height of the central column 2 is essentially equal to the height of the door panel 3, a construction where the door panel 3 and the central column 2 end at basically the same height. In some applications, the height of the door panel 3 is smaller than the height of the central column 1, e.g. if the purpose of the revolving door 1 is to block entrance but not achieving a seal of the opening. The height of the driven column 4 may be adaptable such that the height of the central column 2 is essentially equal to the height of the door panel 3.

The height of the driven column 4 may be adaptable such that the height of the driven column 4 is essentially equal to or larger than the height of the door panel 3. This is in particular an alternative when the driven column 4 extends essentially to the bottom of the central column 2.

In one aspect, the height of the driven column 4 is adjustable. The height of the driven column 4 may be adjustable by means of a telescoping portion. The driven column 4 may comprise an adjustable telescoping end piece, which preferably is located at the top of the driven column 4.

The revolving door assembly has a modular structure, which comprises three main modules, namely the driving base unit 5, the driven column 4 and said at least one door panel 3. The driving base unit 5 is a standard module that is the same for all or at least a large number of revolving doors 1 having different sizes. The driving base unit 5 can be kept completely assembled at stock. The driving base unit 5 may pre-assembled. The driven column 4 is adapted to the installation. The only adaption of the driven column 4 that is required is adaption of the height of the driven column 4, or the top column part 8 if the driven column 4 is divided into two parts, in which latter case the bottom column part 7 may be premounted to the driving base unit 5, e.g. when kept at stock. The height of the driven column 4 can be adapted. The door panels 3 are also easily adapted to the specific installation, e.g. by cutting the frames and glass panels to a desired size. This can also be done at the manufacturer's factory or a retailer's workshop or at the site of installation, and possibly by a local glazier.

The modular revolving door assembly 1 reduces delivery times and reduces the number of models that have to be kept at stock. The modular revolving door assembly 1 also reduces the installation time since the complete driving base unit 5 including the drive unit 6 is mounted to the floor, the driven column 4 is attached to the driving base unit 5 (before or after mounting of the driving base unit 5 to the floor), the door panels 3 are attached to the driven column 4 and then the drive unit 6 only has to be connected to a power supply. No other fitting is required at the site of installation.

The revolving door assembly 1 may be an automatic revolving door assembly 1. The automatic revolving door assembly 1 may be automated by means of the drive unit 6.

The drive unit 6 is located within the central column 2. By locating the drive unit 6 in the central column 2 an aesthetic design is achieved, which does not involve any covering boxes or screens. It also implies a compact design, e.g. a narrow central column 2. It also facilitates the installation of the revolving door assembly 1, since the complete driving base unit 5 including the drive unit 6 can be pre-assembled and delivered as one unit. This also implies easy and fast replacement of a revolving door in case of breakdown. Further, no machining of the floor is needed, possibly except for a groove for a cable if supplied at the bottom of the revolving door assembly.

It is possible to only attach the revolving door assembly to the floor at the centre of the revolving door assembly 1 further facilitating arrangement of the revolving door assembly as a freestanding door and further facilitating the installation of the revolving door assembly. Locating the drive unit 6 in the central column 2 enables high door panels 3 extending all the way from the floor to the ceiling.

In one aspect, the revolving door assembly 1 is freestanding. This implies that the revolving door assembly 1 can stand by its own. It is sufficient to mount the driving base unit 5 to the floor or any other suitable foundation, e.g. by mounting the support structure 14 to the floor or foundation. Thus, the revolving door assembly 1 does not have to have any other support. For example the revolving door assembly 1 does not have to be connected to the ceiling or the top of the opening and the revolving door assembly 1 does not have to be provided with any bearing at the top. The revolving door assembly 1 is arranged to be completely supported at the bottom of the opening. The revolving door assembly 1 is completely journalled on the driving base unit 5. Thereby, the revolving door assembly 1 is void of bearings at the top of the driven column 1. At the top of the driven column 1 the revolving door assembly 1 is void of bearings, guiding means and other attachment means for connection to the boundaries of the opening, such as the top of the opening. Also the driving base 5 unit may be freestanding. The central column 2 may have an upper free end. The upper free end is void of bearings. The driven column of the central column may have an upper free end. The upper free end is void of bearings.

Alternatively, the revolving door assembly 1 may have a top bearing at the top of the central column 2 that guides and stabilizes the revolving door assembly 1. Such a top bearing may in particular be present in large revolving door assemblies 1 and/or where such a top bearing not will be detrimental, neither in terms of space or appearance. However, in many applications such a top bearing may not be necessary and the construction described herein will be sufficiently stable without any top bearing.

In some embodiments, a majority of the radial forces are absorbed at the bottom of the revolving door assembly. Thereby, only a minority of the radial forces is absorbed at the bottom of the revolving door assembly and thus only a small or no bearing or support is necessary at the top of the revolving door assembly. In some embodiments, at least 50% of the radial forces are absorbed at the bottom of the revolving door assembly. In some embodiments, at least 60%, such as at least 70%, such as at least 80%, such as at least 90%, of the radial forces are absorbed at the bottom of the revolving door assembly. Thereby a yet smaller bearing is needed at the top of the revolving door, or no bearing is needed at the top of the revolving door assembly. The majority of the radial forces may be absorbed by the at least one bearing 15, 16 described below. The bearing 15, 16 may be comprised in the driving base unit 5 of the central column 2 and may be mounted to the support structure 14.

The driving base unit 5 is arranged to be mounted at the bottom of the opening. The driving base unit 5 may be arranged to be mounted on the bottom of the opening. The driving base unit 5 may be arranged to be mounted to the floor in the opening. The driving base unit 5 is arranged to be mounted in level with or above a surrounding floor. Thereby, the driving base unit 5 is mounted in floor level or above the floor level, such as on a threshold, base or support. Thereby also the revolving door assembly 1 is mounted in level with or above a surrounding floor and the installation is further facilitated. Neither separate support nor any specific preparations at the installation site are needed. The driving base unit 5 can be mounted directly on the floor. The driving base unit 5 may be supported essentially in level with a surrounding floor. Thereby the driving base unit 5 and also the revolving door assembly 1 are carried essentially in floor level and the installation is further facilitated. Neither separate support nor any specific preparations at the installation site are needed. The driving base unit 5 may be arranged to be mounted at the bottom of the opening essentially in floor level. The driving base unit 5 may be arranged to be mounted at the bottom of the opening essentially in level with a surrounding floor. The driving base unit 5 may be supported essentially in level with a surrounding floor. The point of support of the driving base unit 5 may be in a plane essentially coinciding with a surrounding floor. The point of support of the driving base unit 5 may be in a plane parallel to and essentially coinciding with a surrounding floor. The driving base unit 5 may be arranged to be mounted to a bottom restriction, such as a lower surface, of an opening in which the revolving door assembly is to be installed, e.g. to a flooring. The driving base unit 5 may be arranged to be attached to the bottom restriction. The driving base unit 5 may be arranged to be fixed to the bottom restriction. The driving base unit 5 may be statically mounted to the bottom restriction. The support structure 14 of the driving base unit may be static. The support structure 14 of the driving base unit may be arranged to be fixed relative to the bottom restriction.

The driving base unit 5 is arranged to be supported at the centre of the revolving door assembly 1. Thus, the weight of the driving base unit 5 and the components supported by the driving base unit 5 is carried at the centre of the revolving door 1. The driving base unit 5 may be arranged to be completely supported at the centre of the revolving door assembly 1. Thus, the driving base unit 5 is supported only at the centre of the revolving door assembly 1. The driving base unit 5 may be arranged to be supported at the bottom of the opening. The driving base unit 5 is arranged to be supported by the bottom of the opening at the centre of the revolving door assembly 1. The driving base unit 5 may be arranged to be supported by the bottom restriction of the opening at the centre of the revolving door assembly 1. The bottom restriction of the opening can be a floor, a threshold, a ground or any other foundation on which the revolving door assembly 1 is installed.

The driven column 4 comprises a bottom column part 7 connected to the driving base unit 5 and a top column part 8 connected to the bottom column part 7. The height of the top column part 8 is adaptable. By dividing the driven column 4 in two parts, a bottom column part 7 and a top column part 8, the bottom column part 8 can be pre-fitted to the driving base unit 5 e.g. at the manufacturer before shipping. Thereby, the installation at the site of installation can be easier. The transport of the revolving door assembly is also facilitated since the top column part 8 is shorter than the driven column 4, and at the same time the number of transported pieces can be maintained since the bottom column part 7 may be pre-fitted to the driving base unit 5. The complete driving base unit 5 having the bottom column part 7 mounted to the driving base unit 5 may be pre-fitted and may be ready on stock for fast delivery. Then only the top column part 8 have to be adapted to the installation, e.g. at the manufacturer or at the installation site. The top column part 8 is situated on top of the bottom column part 7. The height of the top column part 8 can be easily adapted e.g. by cutting a top column to a desired height (which can be seen as a length before installation). The top column part 8 can also be provided in various heights to fit different installations. The bottom column part 7 may have a standard height. The combination of the driving base unit 5 having the bottom column part 7 mounted to the driving base unit 5 may have a standard height. The top column part 8 may be connected to the bottom column part 7 by a connection means 45.

The drive unit 6 is enclosed within the bottom column part 7. By enclosing the drive unit within the bottom column part, the time for installation and replacement of a revolving door assembly is further reduced and handling is facilitated, since the drive unit is enclosed within the bottom column part that may be pre-assembled to the driving base unit and the drive unit does not protrude out of the bottom column part.

The drive unit 6 also comprises a gear 11. The gear 11 is arranged to rotate the door panels 3 connected to the central column 2 around said central axis. The gear 11 is arranged to rotate the driven column 4 and the door panels 3 connected to the driven column 4 around said central axis X. The gear 11 is arranged to rotate the door panels 3 by means of the motor 13. The gear 11 is arranged to transmit a rotating movement of the motor 13 to a rotating movement of the door panel 3. The gear 11 is a gear box comprising a plurality of gearwheels 17, 23.

The gear 11 is an oscillating gear 11. As used herein oscillating means a repetitive non-rotating movement about an axis. The oscillating gear 11 is arranged to transform a rotating movement from the motor 13 into an oscillating movement in the gear 11 and back to a rotating movement of the door panel 3. An input member 19 of the gear is rotated by the motor 13. An output member 23 of the gear 11 rotates. The output member 23 is connected to the door panel 3 such that the door panel 3 rotates. The output member 23 is connected to the driven column 4 such that the driven column 4 rotates. The door panel 3 is connected to the driven column 4 and thereby the door panel 3 rotates when the driven column 4 rotates. An oscillating part 17 is arranged between the input member 19 and the output member 23. The oscillating gear 11 may be arranged to transform a rotating movement from the motor 13 into an oscillating movement of an oscillating part 17 of the gear 11 and to transform said oscillating movement of said oscillating part 17 into a rotating movement of a rotating output member 23 of said gear 11. The rotating movement from the motor 13 may be transferred to a rotating movement of an input member 19 of the gear 11. The oscillating gear 11 may be arranged to transform the rotating movement of the input member 19 of the gear 11 into an oscillating movement of the oscillating part 17 of the gear 11.

The gear 11 comprises an inner external gearwheel 17 driving an outer internal gearwheel 23, wherein the inner external gearwheel 17 comprises at least two cylindrical crankshaft holes 24, wherein each crankshaft hole 23 is arranged at a distance from the periphery of the inner external gearwheel 17 and at a distance from the centre of the inner external gearwheel 17, wherein in at least two of the crankshaft holes 23 a crankshaft 19, 27 is arranged. Preferably, the inner external gearwheel 17 comprises at least three cylindrical crankshaft holes 24, wherein each crankshaft hole 23 is arranged at a distance from the periphery of the inner external gearwheel 17 and at a distance from the centre of the inner external gearwheel 17, wherein in at least three of the crankshaft holes 23 a crankshaft 19, 27 is arranged. The crankshaft 19, 27 may be an eccentric shaft. The inner external gearwheel 17 can be seen as the oscillating part 17 mentioned above. The outer internal gearwheel 23 can be seen as the output member 23 mentioned above. The inner external gearwheel 17 has external teeth 25 (also named cogs) turned radially outwards seen from a gear centre axis of the gear 11. The outer internal gearwheel 23 is arranged radially outside the inner external gear wheel 17. The outer internal gearwheel 23 essentially encloses the circumference of the inner external gearwheel 17. The outer internal gearwheel 23 has internal teeth 26 (also named clogs) turned radially inwards. The internal teeth 26 of the outer internal gear wheel 23 intermesh with the external teeth 25 of the inner external gearwheel 17. The inner external gearwheel 17 oscillates due to the movement of the eccentric crankshafts 19, 27 arranged in the crankshaft holes 24 of the inner external gearwheel 17. Due to intermeshing of the teeth 25, 26 of the gearwheels 17, 23, the oscillating movement of the inner external gearwheel 17 rotates the outer internal gearwheel 23.

The oscillating gear 11 comprises a large output gearwheel (the outer internal gearwheel 23) in relation to the space occupied by the gear 11. The gear 11 is high-geared, i.e. the output torque of the output member 23 is significantly higher than the input torque of the input member 19. Also, the speed of rotation of the output member 23 (e.g. in revolutions per minute) is significantly lower than the speed of rotation of the input member 19. The gear ratio may for example be about 17.

The crankshafts 19, 27 are arranged on the driving base unit 5. The crankshafts 19, 27 are rotatably attached on the driving base unit 5. The crankshafts 19, 27 may be rotatably arranged on the support structure 14 of the driving base unit 5.

One of the crankshafts 19 is connected to and arranged to be rotated by the motor 13. The crankshaft 19 rotated by the motor can be seen as the input member 19 of the gear 11 mentioned above. In some applications, two or more of the crankshafts 19, 27 may be connected to and arranged to be rotated by the motor 13. The crankshaft 19 connected to and rotated by the motor 13 is a driven crankshaft 19.

The central column 2 is arranged centered in relation to the centre axis X of the revolving door assembly 1. That is, the centre of the central column 2 coincides with the centre axis X. The driven column 4 is arranged centered in relation to the centre axis X of the revolving door assembly 1. That is, the centre of the driven column 4 coincides with the centre axis X. The driving base unit 5 is arranged centered in relation to the centre axis X of the revolving door 1. That is, the centre of the driving base unit 5 coincides with the centre axis X. The gear 11 is arranged centered in relation to the centre axis X of the revolving door 1. That is, the centre of the gear 11 coincides with the centre axis X.

The motor 13 is arranged offset in relation to the centre axis X of the revolving door 1. Thereby, some space is available between the motor 13 and the driven column 4. This implies that a through channel such as the column through channel 28 described below, which is a portion of the main through channel 10, can be arranged next to the motor 13. The motor 13 is also arranged offset in relation to the centre of the gear 11. Since the driven crankshaft 19 of the oscillating gear 11 is arranged at a distance from the centre of the gear 11, the motor 13 is easily arranged offset in relation to the centre axis X of the revolving door 1.

The motor 13 is arranged offset in relation to the axis of the crankshaft 19 connected to the motor 13. Thereby, the motor 13 can be arranged displaced from the position in line with the driven crankshaft 19 towards the centre axis X of the revolving door 1 and thus space is saved and the central column 2 as well as the driven column 4 can be made more narrow. That is, the diameter of the driven column 4 can be smaller. However, in order to give space for the column through channel 28 described below, the motor 13 is preferably not displaced to the centre of the revolving door 1, but is arranged offset in relation to the centre axis X of the revolving door 1. The motor 13 is connected to the gear 11 by means of a universal joint 29. The motor 13 is connected to the driven crankshaft 19 by means of a universal joint 29. A universal joint is also called a cardan joint. A universal joint 19 is a suitable way of connecting the motor 13 and the gear 11 and enabling arrangement of the motor 13 offset in relation to the axis of the crankshaft 19 connected to the motor. The universal joint 29 enables transmission from a vertically arranged motor 13 where the motor shaft of the motor is displaced in relation to the driven crankshaft 19 and thereby a compact design, i.e. a central column 2 having a small diameter, is achieved.

The gear 11 comprises a gear through channel 12. The gear through channel 11 achieves a connection through the gear 11 and enables arrangement of e.g. cabling through the gear 11. The gear through channel 12 of the gear 11 connects a top side of the gear 11 with a bottom side of the gear 11. The oscillating part 17 of the gear 11 comprises the gear through channel 12. Thus, the gear through channel 12 is arranged in the oscillating part 17 and connects the top side of the oscillating part 17 with the bottom side of the oscillating part 17. The gear through channel 12 is arranged in the centre of the oscillating part 17.

The central column 2 comprises a main through channel 10. The main through channel 10 achieves a connection through the central column 2 and enables arrangement of e.g. cabling through the central column 2. The main through channel 10 connects the top of the central column 2 with the bottom of the central column 2. The gear through channel 12 is a portion of the main through channel 10.

The driving base unit 5 comprises a base through channel 9. The base through channel 9 achieves a connection through the driving base unit 5 and enables arrangement of e.g. cabling through the driving base unit 5. The base through channel 9 connects the top of the driving base unit 5 with the bottom of the driving base unit 5. The base through channel 9 is a portion of the main through channel 10. The gear through channel 12 is a portion of the base through channel 9.

The support structure 14 comprises a support through channel 22. The support through channel 22 achieves a connection through the support structure 14 and enables arrangement of e.g. cabling through the support structure 14. The support through channel 22 is a portion of the base through channel 9. The support through channel 9 may be comprised in the bottom support 30 of the support structure 14 and connect the top of the bottom support 30 with the bottom of the bottom support 30.

The driven column 4 comprises a column through channel 28. The column through channel 28 achieves a connection through the driven column 4 and enables arrangement of e.g. cabling through the driven column 4. The column through channel 28 connects the top of the driven column 4 with the bottom of the driven column 4. The column through channel 28 is a portion of the main through channel 10.

The gear through channel 12 is arranged to accommodate an electric cable 31. In one aspect, each of the through channels is arranged to accommodate an electric cable 31. The gear through channel 12 may be arranged to accommodate an electric cable 31. The main through channel 10 may be arranged to accommodate an electric cable 31. The base through channel 9 may be arranged to accommodate an electric cable 31. The support through channel 22 may be arranged to accommodate an electric cable 31. The column through channel 28 may be arranged to accommodate an electric cable 31. All of the through channels 9, 10, 12, 22, 28 may be arranged to accommodate an electric cable 31. All of the through channels 9, 10, 12, 22, 28 may be arranged to accommodate the same electric cable 31.

The through channels 9, 10, 12, 22, 28 enable a flexible cable path in the revolving door 1. A cable, such as a power cable, can e.g. be supplied to the revolving door 1 either at the bottom or at the top. For example can a cable, such as a power cable 31, be supplied at the bottom of the revolving door, led through the base through channel 9, including the support through channel 22 and the gear through channel 12 as well as a portion of the column through channel 28, and connected to the motor 13. Alternatively, can a cable be supplied at the top of the revolving door and led through another portion of the column through channel 28 and be connected to the motor 13. The through channels 9, 10, 12, 22, 28 may also be used for other types of cables connecting different devices and units of the revolving door. For example can a cable be connected to the control unit 32, led through a portion of a column through channel 28 and connected to an emergency breakout device located at the top of the revolving door assembly 1.

A portion of the main through channel 10 is arranged parallel to the motor 13. A portion of the main through channel 10 is arranged between the motor 13 and the driven column 4. A portion of the main through channel 10 is arranged between the motor 13 and the wall of the driven column 4. More particular, a portion of the column through channel 28 is arranged parallel to the motor 13. A portion of the column through channel 28 is arranged between the motor 13 and the driven column 4, e.g. in the space established by having the motor 13 offset in relation to the centre axis X of the revolving door 1.

The through channels 9, 10, 12, 22, 28, that is the main through channel 10 and the portions thereof, in particular, the gear through channel 12 enable cables to be supplied both at the top or bottom of the revolving door at the option of the customer with the same design. Further, the through channels 9, 10, 12, 22, 28 eliminate the need for power supply by means of swivel or slip-ring connection commonly used in revolving doors.

The gear 11 comprises at least one rod through hole 18. The rod through hole 18 achieves a connection through the gear 11 and enables arrangement of e.g. static rods through the gear. The rod through hole 18 of the gear connects a top side of the gear 11 with a bottom side of the gear 11. The oscillating part 17 of the gear 11 comprises the rod through hole 18. Thus, the rod through hole 18 is arranged in the oscillating part 17 and connects the top side of the oscillating part 17 with the bottom side of the oscillating part 17. The rod through hole 18 is arranged displaced from the centre of the oscillating part 17. The rod through hole 18 is also arranged displaced from the centre of the gear 11. The gear 11 preferably comprises a plurality of rod through holes 18. The gear shown in FIGS. 3-5 has three rod through holes 18. The rod through holes 18 are arranged to accommodate static rods. The rods may be able to support parts, e.g. a motor, arranged on the opposite side of the gear in relation to where the rods are supported, e.g. on the opposite side of the gear in relation to a support structure to which the rods are mounted.

Figure 4:
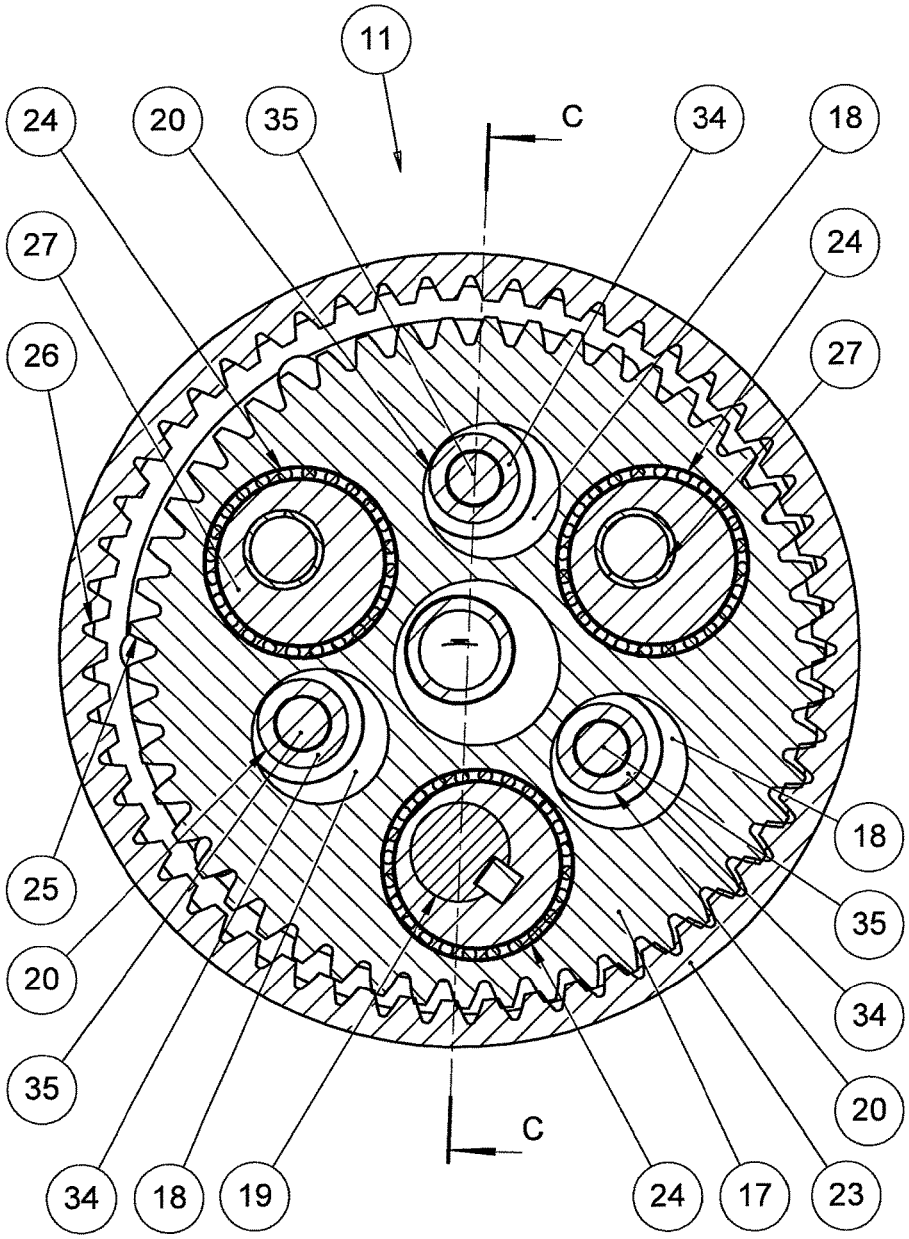
FIG. 4 is a cross sectional view of the driving base unit shown in FIGS. 2 and 3 along the section B-B.

A support rod 20 passes through the rod through hole 18. A support rod 20 may pass through each rod through hole 18. The revolving door assembly shown in the figures has three support rods 20 as seen in FIG. 4. The support rod 20 supports the motor 13. Preferably, the gear comprises at least two rod through holes 18 and at least two support rods 20 passes through the rod through holes 18 in order to increase the stability. More preferably, the gear comprises at least three rod through holes 18 and at least three support rods 20 passes through the rod through holes 18.

The central column 2 comprises a support structure 14. The driving base unit 5 of the central column 2 comprises the support structure 14. The motor 13 is mounted to the support structure 14. The motor 13 is statically mounted to the support structure 14. The drive unit 6 including the motor 13 is mounted to the support structure 14. The drive unit 6 including the motor 13 is statically mounted to the support structure 14. The gear 11 is mounted to the support structure 14. The drive unit 6 including the motor 13 and the gear 11 is mounted to the support structure 14. The control unit 32 is mounted to the support structure 14. The support structure 14 comprises a bottom support 30 having a foot 33. The foot 33 is arranged to be mounted to the floor, e.g. by means of screws or bolts.

The driving base unit 5 comprises support rods 20 passing through the oscillating gear 11 and the motor 13 is connected to the support rods 20. The support structure 14 comprises support rods 20 passing through the oscillating gear 11 and the motor 13 is connected to the support rods 20. The support rods 20 are static and the motor 13 is statically connected to the support rods 20. The oscillating gear 11 comprises rod through holes 18 through which the support rods 20 pass the oscillating gear 11. The support rods 20 may be mounted to the bottom support 30, extend through the oscillating gear 11 and be connected to the motor 13. The motor 13 may be connected to the support rods 20 on the opposite side of the oscillating gear 11 compared to where the support rods 20 are mounted to the bottom support 30. The support rods 20 may pass through the inner external gearwheel 17 of the oscillating gear 11. The inner external gearwheel 17 of the oscillating gear 11 may comprise the rod through holes 18 of the oscillating gear 11. The motor 13 is arranged above the gear 11. The gear 11 is arranged above the bottom support 30. The motor 13 is arranged above the gear 11 and supported below the gear 11. The motor 13 is supported by the bottom support 30 of the support structure 14. The support rod 20 is connected to the bottom support 30 of the support structure 14 below the gear 11 and the motor 13 is connected to the support rod 20 above the gear 11.

Figure 3:
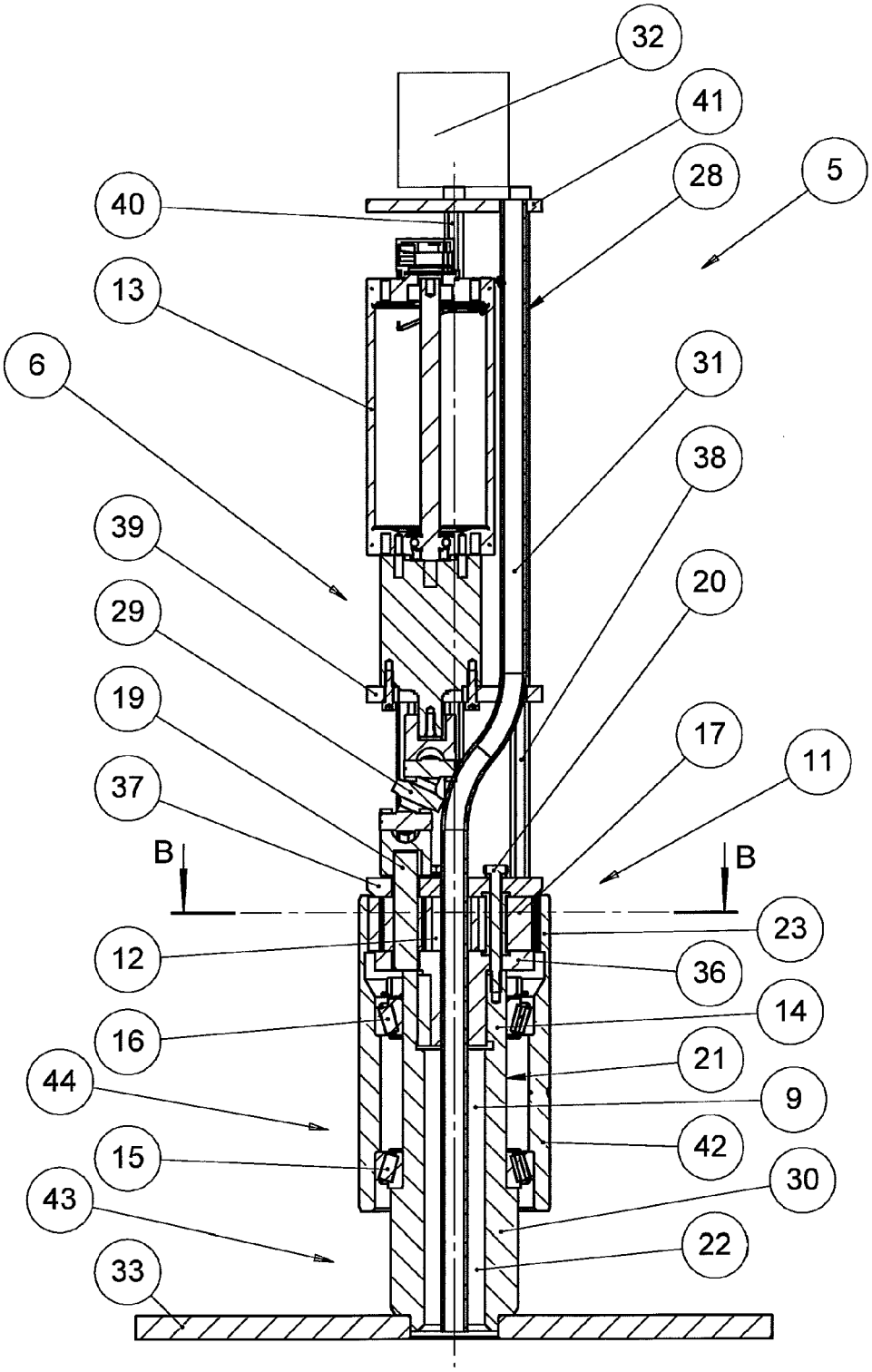
FIG. 3 is a cross sectional view of the driving base unit shown in FIG. 2 along the section A-A.
Figure 5:
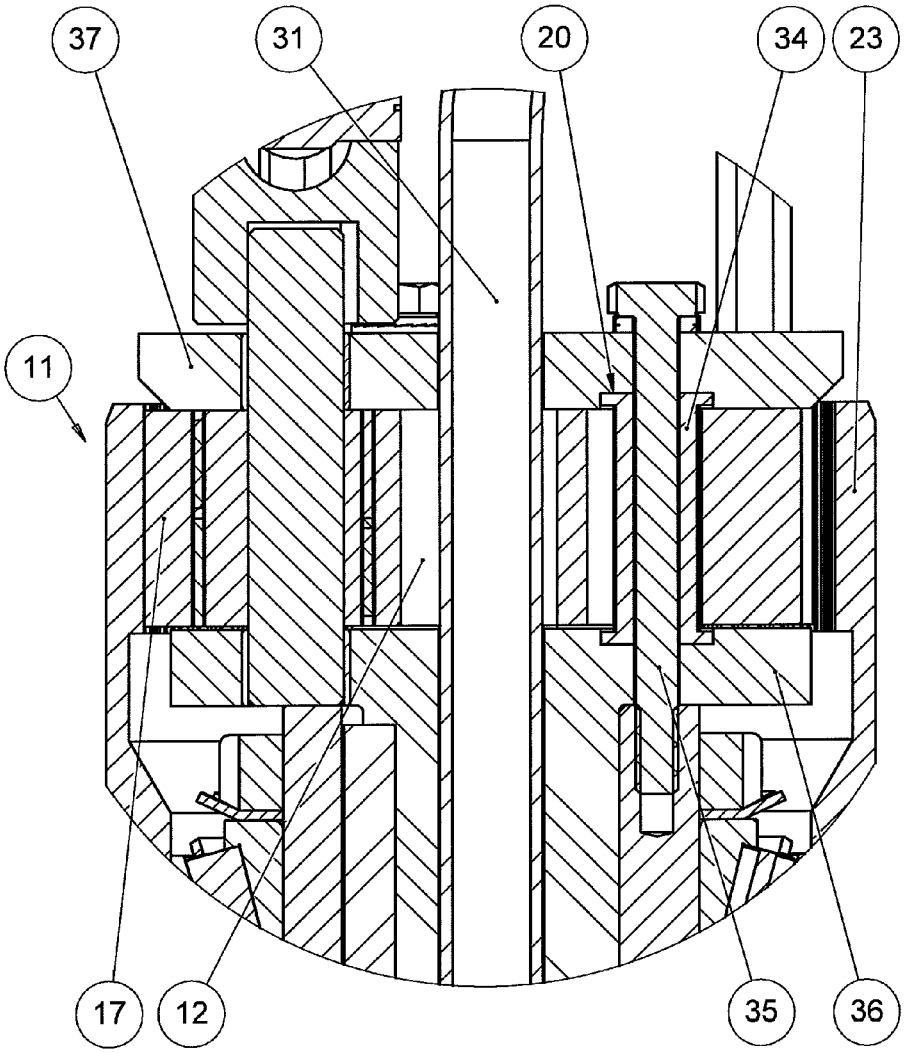
FIG. 5 is a cross sectional view of a portion of the driving base unit shown in FIGS. 2-4 along the section C-C.

The support rods 20 are in FIGS. 3-5 shown as support sleeves 34 and support screws 35. The support sleeves 34 and the support screws 35 mount a lower gear flange 36 and an upper gear flange 37. The oscillating inner external gearwheel 17 is arranged between the lower gear flange 36 and the upper gear flange 37.

The motor 13 is connected to the support rods 20 by motor rods 38 mounted on the upper gear flange 37 and a motor mount 39 mounted on the motor rods 38.

The support structure 14 is arranged to be mounted at the bottom of the opening. The support structure 14 may be arranged to be mounted on the bottom of the opening. The support structure 14 may be arranged to be mounted to the floor in the opening. The support structure is arranged to be mounted in level with or above a surrounding floor. Thereby, the support structure 14 is mounted in floor level or above the floor level, such as on a threshold, base or support. Thereby also the revolving door assembly 1 is mounted in level with or above a surrounding floor and the installation is further facilitated. Neither separate support nor any specific preparations at the installation site are needed. The support structure 14 can be mounted directly on the floor. The support structure 14 may be supported essentially in level with a surrounding floor. Thereby the support structure 14 and also the revolving door assembly 1 is carried essentially in floor level and the installation is further facilitated. Neither separate support nor any specific preparations at the installation site are needed. The support structure 14 may be supported essentially in level with a surrounding floor. The support structure 14 may be arranged to be mounted at the bottom of the opening essentially in floor level. The support structure 14 may be arranged to be mounted at the bottom of the opening essentially in level with a surrounding floor. The support structure 14 may be supported essentially in level with a surrounding floor. The point of support of the support structure 14 may be in a plane essentially coinciding with a surrounding floor. The point of support of the support structure 14 may be in a plane parallel to and essentially coinciding with a surrounding floor. The support structure 14 is arranged to be mounted to a bottom restriction, such as a lower surface, of an opening in which the revolving door assembly is to be installed, e.g. to a flooring. The support structure 14 may be arranged to be attached to the bottom restriction. The support structure 14 may be arranged to be fixed to the bottom restriction. The support structure 14 may be statically mounted to the bottom restriction. The support structure 14 may be static. The support structure 14 may be arranged to be fixed relative to the bottom restriction. The same is valid for the bottom support 30.

The support structure 14 is arranged to be supported at the centre of the revolving door assembly 1. Thus, the weight of the support structure 14 and the components supported by the support structure 14 is carried at the centre of the revolving door 1. The support structure 14 may be arranged to be completely supported at the centre of the revolving door assembly 1. Thus, the support structure 14 is supported only at the centre of the revolving door assembly 1. The support structure 14 may be arranged to be supported at the bottom of the opening. The support structure 14 is arranged to be supported by the bottom of the opening at the centre of the revolving door assembly 1. The support structure 14 may be arranged to be supported by the bottom restriction of the opening at the centre of the revolving door assembly 1. The same is valid for the bottom support 30.

The revolving door assembly 1 is arranged to be supported by the support structure 14, in particular by the bottom support 30 of the support structure 14. The revolving door assembly 1 is arranged to be completely supported by the support structure 14, in particular by the bottom support 30. The complete revolving door assembly 1 is supported by the support structure 14, in particular by the bottom support 30.

The revolving door assembly 1 is arranged to be mounted at the bottom of the opening. The revolving door assembly 1 may be arranged to be mounted on the bottom of the opening. The revolving door assembly 1 may be arranged to be mounted to the floor in the opening. The revolving door assembly 1 is arranged to be mounted in level with or above a surrounding floor. Thereby, the revolving door assembly 1 is mounted in floor level or above the floor level, such as on a threshold, base or support. Thereby the installation is facilitated. Neither separate support nor any specific preparations at the installation site are needed. The revolving door assembly 1 can be mounted directly on the floor. The revolving door assembly 1 may be supported essentially in level with a surrounding floor. Thereby the revolving door assembly 1 is carried essentially in floor level and the installation is facilitated. Neither separate support nor any specific preparations at the installation site are needed. The revolving door assembly 1 may be supported essentially in level with a surrounding floor. The revolving door assembly 1 may be arranged to be mounted at the bottom of the opening essentially in floor level. The revolving door assembly 1 may be arranged to be mounted at the bottom of the opening essentially in level with a surrounding floor. The revolving door assembly 1 may be supported essentially in level with a surrounding floor. The point of support of the revolving door assembly 1 may be in a plane essentially coinciding with a surrounding floor. The point of support of the revolving door assembly 1 may be in a plane parallel to and essentially coinciding with a surrounding floor. The revolving door assembly 1 is arranged to be mounted to a bottom restriction, such as a lower surface, of an opening in which the revolving door assembly 1 is to be installed, e.g. to a flooring. The revolving door assembly 1 may be arranged to be attached to the bottom restriction. The revolving door assembly 1 may be arranged to be fixed to the bottom restriction. The revolving door assembly 1 may be statically mounted to the bottom restriction.

The revolving door assembly 1 is arranged to be supported at the centre of the revolving door assembly 1. Thus, the weight of the revolving door assembly 1 is carried at the centre of the revolving door 1. The revolving door assembly 1 may be arranged to be completely supported at the centre of the revolving door assembly 1. Thus, the revolving door assembly 1 is supported only at the centre of the revolving door assembly 1. The revolving door assembly 1 may be arranged to be supported at the bottom of the opening. The revolving door assembly 1 is arranged to be supported by the bottom of the opening at the centre of the revolving door assembly 1. The revolving door assembly 1 may be arranged to be supported by the bottom restriction of the opening at the centre of the revolving door assembly 1.

The drive unit 6 comprises a control unit 32. The control unit 32 is arranged to control the rotation of the door panel 3. The control unit 32 may be arranged to automatically control the rotation of the revolving door assembly 1. The control unit 32 is arranged to control the operation of the revolving door 1 in a conventional manner and is therefore not further described here.

The control unit 32 is enclosed in the central column 2. Thereby, no separate control unit adapted to the installation site, such as the building in which the revolving door assembly is to be installed and the possibility of placing a control unit at the installation site, is needed. The control can be a standard control unit and possibly kept at stock. Thus, the delivery time of a revolving door is decreased, the installation of a revolving door is facilitated and the time for the installation thereof is reduced. Since the control unit is enclosed within the central column, the control unit is not located outside the central column and not visible from the outside of the revolving door assembly and thus an aesthetic appearance is achieved, which in particular is advantageous when installed in an opening of a building having a glass facade. The control unit is enclosed in the central column and thereby a compact design is achieved.

The control unit 32 comprises electronic equipment controlling the rotation of said at least one door panel 3. Thereby, electronic equipment controlling the rotation of the door panel is enclosed within the central column. No separate installation of electronic equipment is needed. Installation of the revolving door assembly is thereby simplified and facilitated. A compact and aesthetically appealing design is also achieved.

The control unit 32 may be located below the motor 13. Thereby, impact on the control unit from heat emanating from the motor, which to a large extent raises, will be reduced. Thus, the functionality and the endurance of the control unit is improved.

The control unit 32 is also connected to the support rods 20. The control unit 2 is connected to the support rods 20 by control rods 40 mounted on the upper gear flange 37 and a control mount 41 mounted on the control rods 20.

The central column 2 comprises at least one bearing 15, 16 arranged to rotatably support said at least one door panel 3. Thus, said at least one bearing 15, 16 carries the weight of said at least one door panel 3. The driving base unit 5 of the central column 2 comprises the bearing 15, 16. The bearing 15, 16 is mounted to the support structure 14. The bearing 15, 16 may be mounted to the bottom support 30 of the support structure 14.

The motor 13 and the bearing 15, 16 are supported by the support structure 14. Thus, the support structure 14 carries the weight of the motor 13 and the bearing 15, 16 as well as the weight of the components supported by the bearing 15, 16, such as the at least one door panel 3. The motor 13 and the bearing 15, 16 are completely supported by the support structure 14. The drive unit 6 and the bearing 15, 16 are supported by the support structure 14. Thus, the support structure 14 carries the weight of the drive unit 6 and the bearing 15, 16 as well as the weight of the components supported by the bearing 15, 16, such as the at least one door panel 3. The drive unit 6 and the bearing 15, 16 are completely supported by the support structure 14.

Said at least one bearing 15, 16 may be at least a first bearing 15 and a second bearing 16, which first and second bearings 15, 16 are arranged to rotatably support said at least one door panel 3. The second bearing 16 is located at a vertical distance from the first bearing 15. Thus, the first and second bearings 15, 16 are separated from each other in a vertical direction and therefore the revolving door assembly 1 is stabilized and tilting as well as falling of the revolving door assembly 1 is avoided. The first bearing 15 and the second bearing 16 are mounted to the driving base unit 5. Thus, the revolving door assembly 1 is stabilized at the driving base unit 5 and there is no need for any bearing at the top of the revolving door assembly 1. Since the first and second bearings 15, 16 are vertically separated, the width of the central column 2 can be small.

Said at least one bearing 15, 16 is mounted on an outer essentially vertical side 21 of the support structure 14, in particular on an outer essentially vertical side 21 of the bottom support 30 of the support structure 14. The first bearing 15 and the second bearing 16 are mounted on an outer essentially vertical side 21 of the support structure 14, in particular on an outer essentially vertical side 21 of the bottom support 30 of the support structure 14. The first bearing 15 and the second bearing 16 are mounted on an outer essentially vertical side 21 of the support structure 14, in particular on an outer essentially vertical side 21 of the bottom support 30 of the support structure 14, at a vertical distance from each other. This is a convenient way of achieving a stable revolving door assembly 1 where the revolving door assembly 1 only is stabilized and supported by the driving base unit 5 at the bottom of the revolving door assembly 1.

The first bearing 15 and the second bearing 16 are located in the lower half of the central column 2. Thereby, the revolving door assembly is stabilized in the lower half of the central column. Thus, a freestanding revolving door assembly void of bearings at the top is facilitated and enabled. The first bearing 15 and the second bearing 16 are located in the lower half of the driving base unit 5. Thereby, the revolving door assembly is stabilized in the lower half of the driving base unit. Thus, a freestanding revolving door assembly void of bearings at the top is facilitated and enabled. The first bearing 15 and the second bearing 16 may be located below the centre of gravity of the central column 2. The first bearing 15 and the second bearing 16 may be located below the centre of gravity of the driving base unit 2. The first bearing 15 and the second bearing 16 may be located below the motor 13.

The first bearing 15 may be inclined in relation to the central axis X of the revolving door assembly 1. The second bearing 16 may be inclined in relation to the central axis X of the revolving door assembly 1. Both the first bearing 15 and the second bearing 16 may be inclined in relation to the central axis X of the revolving door assembly 1, which is shown in FIG. 3. By having an inclined bearing 15, 16, the bearing 15, 16 takes up radial forces. Thus, the bearing 15, 16 is arranged to take up both axial forces and radial forces. Having two inclined bearings 15, 16 further increases the ability of absorbing forces.

The first bearing 15 may be an angular contact bearing. The second bearing 16 may be an angular contact bearing. Both the first bearing 15 and the second bearing 16 may be an angular contact bearing, which is shown in FIG. 3.

In one aspect, the rotating output member 23 of the gear 11, e.g. the outer internal gearwheel 23, is devised as a column support 42 on which the driven column 4 is mounted. The column support 42 is rotatably attached to the driving base unit 5 by means of said at least one bearing 15, 16. The column support 42 is in particular rotatably attached to the bottom support 30 of the support structure 14 of the driving base unit 5 by means of said at least one bearing 15, 16. The column support 42 is basically shaped as a hollow cylinder. The column support 42 comprises internal teeth 26 on a portion of the inner surface of the column support 42. This can be seen as that the teeth 26 of the outer internal gearwheel 23 are arranged on the inner surface of the column support 42. This aspect relates to a rotating output member 23 integrated with a column support 42, which is shown in FIG. 3. The driven column 4 may be mounted to the column support 42 e.g. by screws.

Alternatively may a separate column support be provided and rotatably attached to the driving base unit 5. The rotating output member of the gear may be statically connected to the column support. The column support may also in this embodiment be basically shaped as a hollow cylinder and the rotating output member, e.g. an outer internal gearwheel, may be mounted on the inside the column support. This alternative relates to a separate rotating output member and a separate column support connected to each other. The driven column 4 may be mounted to the column support e.g. by screws.

As a second alternative, internal teeth may be provided on an inside surface of the driven column and the driven column may be rotatably attached to the driving base unit 5 by means of said at least one bearing 15, 16. This alternative relates to a driven column having the rotating output member of the gear integrated in the driven column. The driven column is directly rotatably attached to the driving base unit and therefore no column support is needed.

In one aspect, the driven column 4 encloses the driving base unit 5 and may be mounted to an outer surface of the column support 42. In this aspect the driven column 4 basically has the same height as the revolving door assembly 1. In this aspect, the driven column 4 is preferably divided into two parts, a bottom column part 7 and a top column part 8, as described above. In this aspect, the door panels 3 are preferably attached at the top and bottom of the driven column 4.

Alternatively, the driven column may be mounted to a top portion of the column support and extending mainly upwards seen from the column support. The column support may then be devised as a cylinder extending downwards towards the floor. In this aspect, the door panels are preferably attached at the top of the driven column and at the bottom of the column support. In this aspect, the driven column may be shorter and thus transport is facilitated.

The revolving door assembly 1 may comprise a second gear 43 arranged between the motor 13 and the first gear 11. The second gear 43 reduces the speed of the motor 13 and increases the torque of the motor 13 in a first step. The second gear 43 may comprise a plurality of gears arranged in series between the motor 13 and the first gear 11. The plurality of gears of the second gear 43 reduces the speed of the motor 13 and increases the torque of the motor 13 in a plurality of steps. The gear ratio of the (plurality of) second gear 43 may for example be about 17. The total gear ratio of the oscillating gear 11 and the (plurality of) second gear 43 may for example be about 300. The speed of rotation of the motor 13 may for example be about 3000 revolutions per minute (rpm) and then the total gear ratio of the oscillating gear 11 and the (plurality of) second gear 43 may be about 300.

The driving base unit 5 can be seen as comprising a fixed base part 43 and a rotating base part 44. The rotating base part 44 can be seen to comprise the column support 42 and the outer internal gearwheel 23 of the gear 11. The fixed base part 43 can be seen to comprise the support structure 14, the motor 13 and the gear 11 except the outer internal gearwheel 23. The rotating base part 44 is rotatably attached to the fixed base 43 part by means of said at least one bearing 15, 16. The fixed base part 43 may also be seen to comprise the drive unit 6, the support rods 20, the motor mount 39, the motor rod 38, the control mount 41, the control rod 40 and/or the universal joint 29 as well as the base through channel 9. The fixed base part 43 is adapted to be mounted at the bottom of the opening. The fixed base part 43 may be adapted to be mounted to the bottom of the opening. The fixed base part 43 may be adapted to be mounted to a bottom restriction, such as a lower surface, of an opening in which the revolving door assembly is to be installed, e.g. to a flooring. The fixed base part 43 may be adapted to be attached to the bottom restriction. The fixed base part 43 may be adapted to be fixed to the bottom restriction. The fixed base part 43 may be statically mounted to the bottom restriction. The fixed base part 43 may be arranged to be fixed relative to the bottom restriction. The driven column 4 is connected to the rotating base part 44.

In one aspect, the present invention relates to a modular revolving door assembly 1 for installation in an opening, comprising a central column 2 and at least one door panel 3 connected to the central column 2 and rotatably arranged around a central axis X, wherein the central column 2 comprises a driven column 4 and a driving base unit 5, the driving base unit 5 comprises a drive unit 6, the driving base unit 5 is arranged to be mounted at the bottom of the opening, the driven column 4 is mounted to the driving base unit 5, the driving base unit 5 is arranged to drive the driven column 4 to rotate the driven column 4 and the door panels 3 connected to the driven column 4 around said central axis X, and the height of the driven column 4 is adaptable.

In one aspect, the present invention relates to a revolving door assembly 1 comprising a central column 2 and at least one door panel 3 connected to the central column 2 and rotatably arranged around a central axis X, wherein the central column 2 comprises a drive unit 6 comprising a motor 13 and a gear 11, wherein the gear 11 comprises a gear through channel 12.

In one aspect, the present invention relates to a revolving door assembly 1 comprising a central column 2 and at least one door panel 3 connected to the central column 2 and rotatably arranged around a central axis X, wherein the central column 2 comprises a drive unit 6 comprising a motor 13 and a gear 11, wherein the gear 11 comprises at least one rod through hole 18, wherein a support rod 20 passes through the rod through hole 18 and supports the motor 13.

In one aspect, the present invention relates to a revolving door assembly 1 comprising a central column 2 and at least one door panel 3 connected to the central column 2 and rotatably arranged around a central axis X, wherein the central column 2 comprises a support structure 14 and a drive unit 6 including a motor 13 arranged to rotate said at least one door panel 3 around said central axis X, wherein the central column 2 comprises at least one bearing 15, 16 arranged to rotatably support said at least one door panel 3, and wherein the motor 13 and the bearing 15, 16 is mounted to the support structure 14.

In one aspect, the present invention relates to a driving base unit 5 for a revolving door assembly 1 comprising a central column 2 and at least one door panel 3 connected to the central column 2 and rotatably arranged around a central axis X, wherein the driving base unit 5 comprises a support structure 14 and a drive unit 6 including a motor 13 arranged to rotate said at least one door panel 3 around said central axis X, wherein the driving base unit 5 comprises at least one bearing 15, 16 arranged to rotatably support said at least one door panel 3, and wherein the motor 13 and the bearing 15, 16 are mounted to the support structure 14.

In one aspect, the present invention relates to a revolving door assembly 1 comprising a central column 2 and at least one door panel 3 connected to the central column 2 and rotatably arranged around a central axis X, wherein the central column 2 comprises a motor 13 and a gear 11, wherein the gear 11 is an oscillating gear 11, which is arranged to transform a rotating movement from the motor 13 into an oscillating movement of an oscillating part 17 of the gear 11 and to transform said oscillating movement of said oscillating part 17 into a rotating movement of the door panel 3.

In one aspect, the present invention relates to a revolving door assembly 1 comprising a central column 2 and at least one door panel 3 connected to the central column and rotatably arranged around a central axis X, wherein the central column 2 comprises at least a first bearing 15 and a second bearing 16, which first and second bearings 15, 16 are arranged to rotatably support said at least one door panel 3, wherein the first bearing 15 is located at a vertical distance from the second bearing 16.

A method for installing the modular revolving door assembly 1 in an opening comprises the steps:

adapting the height of the driven column 4 based on the height of the opening, mounting the driven column 4 to the driving base unit 5, and mounting the driving base unit 5 at the bottom of the opening.

These steps may be performed in any order. For example, first the height of the driven column 4 can be adapted based on the height of the opening, e.g. by cutting the driven column 4 to a desired height that suits the opening in which the revolving door assembly 1 is to be installed. The adaption of the driven column 4 can be made in the factory of the manufacturer, in a workshop or at the site of installation. Thereafter, the driven column 4 is mounted to the driving base unit 5 and thereafter the combined driving base unit 5 and driven column 4 is put in place and the driving base unit 5 is mounted at the bottom of the opening.

Alternatively, the height of the driven column 4 can first be adapted as above and thereafter the driving base unit 5 is put in place and mounted at the bottom of the opening. Thereafter the driven column 4 is mounted to the driving base unit 5.

As a further alternative, the driving base unit 5 can first be put in place and mounted at the bottom of the opening. Thereafter the height of the driven column 4 is adapted based on the height of the opening, e.g. by cutting the driven column 4 to a desired height that suits the opening in which the revolving door assembly 1 is to be installed. Thereafter, the driven column 4 is mounted to the driving base unit 5.

The driving base unit 5 may be mounted such that it is supported essentially in level with a surrounding floor. The driving base unit 5 may be mounted to the floor in the opening. The driving base unit 5 may be mounted in floor level or above.

The method may further comprise the step of connecting the at least one door panel 3 to the central column 2. This step is preferably performed after the above method steps. The at least one door panel 3 may be connected to the driven column 4 of the central column 2.

In case the driven column 4 comprises a bottom column part 7 and a top column part 8, the height of the driven column 4 is adapted by adapting the height of the top column part 8 based on the height of the opening. In this case, the driven column 4 is mounted to the driving base unit 5 by mounting the bottom column part 7 to the driving base unit 5, and the method comprises the step of connecting the top column part 8 to the bottom column part 7. In this case, the step of adapting the height of the driven column 4 based on the height of the opening is preferably achieved by adapting the height of the top column part 8 based on the height of the opening and the height of the bottom column part 7.

Mounting of the bottom column part 7 to the driving base unit 5 can be made before or after adapting of the height of the top column part 8. The step of connecting the top column part 8 to the bottom column part 7 can be made before or after the step mounting the driving base unit 5 at the bottom of the opening. It is possible to mount the bottom column part 7 to the driving base unit 5 first and this can be made already during manufacturing of the driving base unit 5. In this case the driving base unit 5 and the bottom column part 7 are delivered as one unit and then only the top column part 8 and the door panels 3 are mounted at the site of installation.

The method may be for installing a revolving door assembly 1 according to any one of the embodiments and variants described above. The method may then be adapted to and comprise steps that suit the particular embodiment or variant.

If the revolving door assembly comprises a top bearing at the top of the central column 2, the method may comprise the step of rotatably mounting the driven column 4 to the top of the opening.

The foregoing has described the principles, preferred embodiments and aspects and modes of operation of the present invention. However, the description should be regarded as illustrative rather than restrictive, and the invention should not be limited to the particular embodiments and aspects discussed above. The different features of the various embodiments and aspects of the invention can be combined in other combinations than those explicitly described. It should therefore be appreciated that variations may be made in those embodiments and aspects by those skilled in the art without departing from the scope of the present invention as defined by the following claims.

The invention claimed is:

1. A revolving door assembly comprising a central column and at least one door panel connected to the central column and rotatably arranged around a central axis, wherein the central column comprises a drive unit, wherein the drive unit comprises a motor (13) and an oscillating gear, wherein the gear comprises at least one rod through hole, and wherein a non-rotating support rod passes through the rod through hole and supports the motor.

2. A revolving door according to claim 1, wherein the oscillating gear further comprises a gear through channel (12).

3. A revolving door assembly according to claim 1 or 2, wherein the rod through hole of the gear connects a top side of the gear with a bottom side of the gear.

4. A revolving door assembly according to claim 2, wherein the gear comprises an oscillating part, and wherein the oscillating part comprises the rod through hole.

5. A revolving door assembly according to claim 4, wherein the rod through hole is arranged displaced from the center of the oscillating part.

6. A revolving door assembly according to claim 4, wherein the gear through channel is arranged in the center of the oscillating part.

7. A revolving door assembly according to claim 1, wherein the oscillating gear is arranged to transform a rotating movement from the motor into an oscillating movement in the gear and back to a rotating movement of the door panel.

8. A revolving door assembly according to claim 1, wherein the central column comprises a driven column and a driving base unit, wherein the driving base unit comprises the drive unit, the support rods and the motor, and wherein the motor is connected to the support rods.

9. A revolving door assembly according to claim 1, wherein the support rod is static.

10. A revolving door assembly according to claim 1, wherein the motor is arranged offset in relation to the center axis of the revolving door assembly.

11. A revolving door assembly according to claim 1, wherein the motor is arranged offset in relation to an input member of the gear.

12. A revolving door assembly according to claim 1, wherein the revolving door assembly is freestanding.

13. A driving base unit for a revolving door assembly comprising a central column and at least one door panel connected to the central column and rotatably arranged around a central axis, wherein the driving base unit comprises a drive unit, wherein the drive unit comprises a motor and an oscillating gear, wherein the oscillating gear comprises at least one rod through hole, and wherein a non-rotating support rod passes through the rod through hole and supports the motor.

14. A driving base unit according to claim 13, wherein the oscillating gear comprises a gear through channel.

* * * * *